US009535349B2

(12) United States Patent
Sakai et al.

(10) Patent No.: US 9,535,349 B2
(45) Date of Patent: Jan. 3, 2017

(54) ELECTROSTATIC CHARGE IMAGE DEVELOPING TONER, ELECTROSTATIC CHARGE IMAGE DEVELOPER, AND TONER CARTRIDGE

(71) Applicant: FUJI XEROX CO., LTD., Tokyo (JP)

(72) Inventors: Motoko Sakai, Kanagawa (JP); Shuji Sato, Kanagawa (JP); Yosuke Tsurumi, Kanagawa (JP); Masaaki Usami, Kanagawa (JP); Takuro Watanabe, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/812,248

(22) Filed: Jul. 29, 2015

(65) Prior Publication Data

US 2016/0216623 A1 Jul. 28, 2016

(30) Foreign Application Priority Data

Jan. 28, 2015 (JP) ..... 2015-014017

(51) Int. Cl.

| | |
|---|---|
| ***G03G 9/09*** | (2006.01) |
| ***G03G 9/08*** | (2006.01) |
| ***G03G 9/087*** | (2006.01) |

(52) U.S. Cl.

CPC ..... *G03G 9/0819* (2013.01); *G03G 9/08755* (2013.01); *G03G 9/09* (2013.01)

(58) Field of Classification Search

CPC ..... G03G 9/0902

See application file for complete search history.

(56) References Cited

U.S. PATENT DOCUMENTS

| | | | | |
|---|---|---|---|---|
| 7,326,507 | B2 * | 2/2008 | Schulze-Hagenest | C09C 1/62 106/403 |
| 2009/0111040 | A1 * | 4/2009 | Veregin | G03G 9/08755 430/108.3 |
| 2011/0318063 | A1 | 12/2011 | Takahashi et al. | |
| 2011/0318682 | A1 | 12/2011 | Takahashi et al. | |
| 2013/0323633 | A1 * | 12/2013 | Takahashi | G03G 9/0902 430/105 |

FOREIGN PATENT DOCUMENTS

| | | | |
|---|---|---|---|
| JP | S62-67558 | A | 3/1987 |
| JP | S62-100769 | A | 5/1987 |
| JP | 2012-032765 | A | 2/2012 |

* cited by examiner

*Primary Examiner* — Hoa V Le

(74) *Attorney, Agent, or Firm* — Oliff PLC

(57) ABSTRACT

An electrostatic charge image developing toner includes a toner particles containing a binder resin and a metallic pigment and aliphatic acid metal salt particles as an external additive in an amount of from 0.1 parts by weight to 2.0 parts by weight with respect to 100 parts by weight of the toner particles, wherein the toner particles have an average circle equivalent diameter D longer than an average C of a maximum thickness of the toner particles.

12 Claims, 3 Drawing Sheets

ELECTROSTATIC CHARGE IMAGE DEVELOPING TONER, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2015-014017 filed Jan. 28, 2015.

BACKGROUND

1. Technical Field

The present invention relates to an electrostatic charge image developing toner, an electrostatic charge image developer, and a toner cartridge.

2. Related Art

Methods for visualizing image information through an electrostatic charge image, such as xerography, are currently used in various fields.

In the xerography in the related art, there is generally used a method of visualizing image information through a plurality of processes including: forming an electrostatic latent image on a photoreceptor or an electrostatic recording medium using various methods; attaching test conductive particles, called a toner, onto the electrostatic latent image to develop the electrostatic latent image (toner image); transferring the developed electrostatic latent image to the surface of a transfer medium; and fixing the transferred electrostatic latent image by heating.

Among toners, brilliant toners are used for the purpose of forming an image having brilliance such as metallic luster.

SUMMARY

According to an aspect of the invention, there is provided an electrostatic charge image developing toner including:

a toner particle containing a binder resin and a metallic pigment; and aliphatic acid metal salt particles as an external additive in an amount of from 0.1 parts by weight to 2.0 parts by weight with respect to 100 parts by weight of the toner particles, wherein the toner particles have an average circle equivalent diameter D longer than an average C of a maximum thickness of the toner particle.

BRIEF DESCRIPTION OF THE DRAWINGS

Exemplary embodiments of the present invention will be described in detail based on the following figures, wherein.

DETAILED DESCRIPTION

Figure 1:
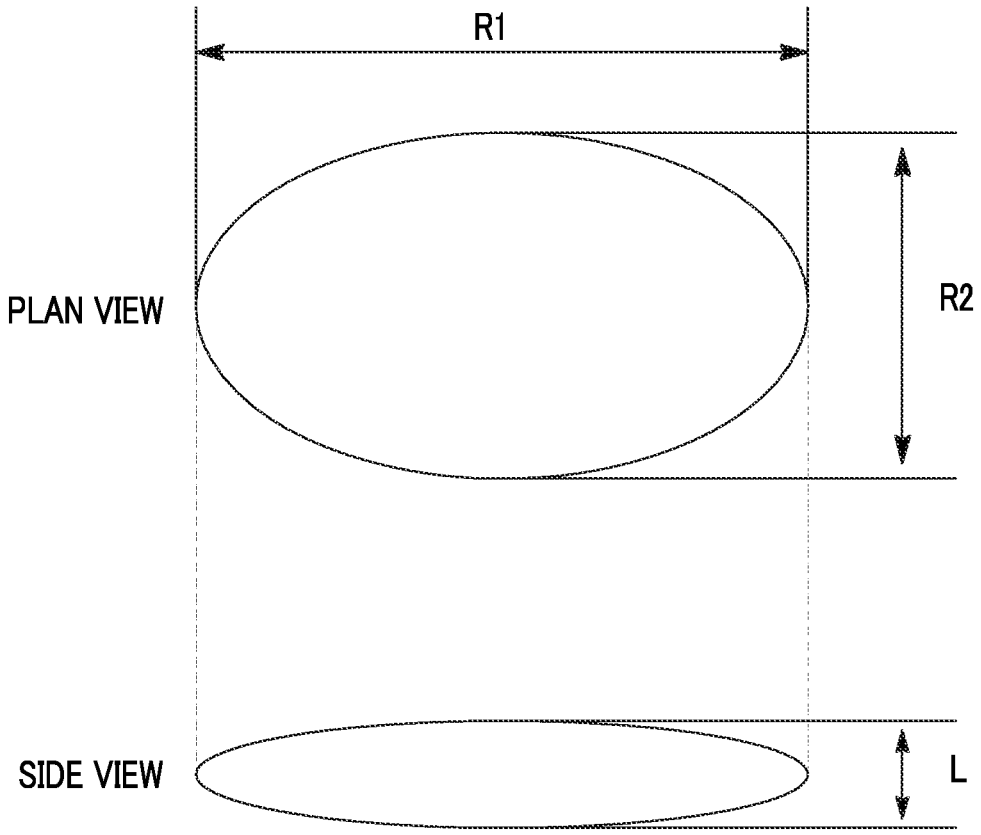
FIG. 1 shows a plan view and side view schematically illustrating an example of an electrostatic charge image developing toner according to the exemplary embodiment.

Hereinafter, the exemplary embodiment of the invention will be described.

In the exemplary embodiment, the description "A~B" represents not only the range between A and B but also the range including A and B as both ends thereof. For example, if the "A~B" is a numerical range, it represents "A or more and B or less" or "B or more and A or less".

Further, in the exemplary embodiment, "parts by mass" and "% by mass" are synonymous with "parts by weight" and "% by weight", respectively.

Electrostatic Charge Image Developing Toner

The electrostatic charge image developing toner according to the exemplary embodiment (hereinafter, referred to as "toner" or "brilliant toner) includes: a toner particle containing a binder resin and a metallic pigment; and an external additive containing an aliphatic acid metal salt particle in an amount of from 0.1 parts by weight to 2.0 parts by weight with respect to 100 parts by weight of the toner particles. Here, the toner particles is characterized in that the average circle equivalent diameter D is longer than the average C of a maximum thickness of the toner particles.

In addition, the expression "having brilliance" in the exemplary embodiment means that when viewing an image formed by toner, the image has brightness such as metallic luster.

Further, the expression "such as metallic luster" means that, in the electrostatic charge image developing toner, in the case of forming a solid image with the toner, the ratio (A/B) of reflectance A at light-receiving angle+30° to reflectance B at light-receiving angle−30°, the light-receiving angle being measured when the incident light of incident angle−45° is applied to the image by a goniophotometer, is from 2 to 100.

In the toner containing a metallic pigment as a colorant, in order to obtain an image exhibiting sufficient brilliance, there is a need to efficiently dispose the metallic pigment on a recording medium. When the toner particle contain a flake shape brilliant pigment with a large particle size, and toner particles are arranged such that the long axis side of the toner particles faces the surface of the recording medium, it is possible to efficiently dispose the brilliant pigment and sufficiently exhibit brilliance.

The present inventors have conducted detailed studies, and, as a result, they found that a part of toner developed by receiving a transfer electric field rises once (long axis side of the toner particle is aligned to be away from the surface of a transfer medium), and is then pressed against a fixing member by the contact with the fixing member, and thus toner particles are arranged such that the long axis side of the toner faces the surface of a recording medium again. When the deterioration of the toner is accelerated by physical stress over time, the contact area between toner particles becomes large because of a flake shape, and it is easy to accelerate the aggregation of toner particles. Therefore, the toner particles hardly rise uniformly when they receive a transfer electric field, the toner particles move in a state in which toner particles are aggregated even under stress by the fixing member, and it is impossible to align toner particles such that the long axis side of the toner particle faces the surface of a recording medium.

The present inventors have further conducted intensive studies, and, as a result, they found that, when the toner contains aliphatic acid metal salt particles as an external additive, the average circle equivalent diameter D of toner particles is longer than the average C of a maximum thickness of the toner particles thereof, and the content of the aliphatic acid metal salt particles is from 0.1 parts by weight to 2.0 parts by weight with respect to 100 parts by weight of the toner particles, the uniformity of the brilliance in the obtained image is excellent even under physical stress over time. The inventors have completed the present invention, based on the finding.

The detailed mechanism is unclear, but is predicted as follows.

When an aliphatic acid metal salt is used, even in a situation where deterioration of the toner (external additive embedded) proceeds due to physical stress, the aliphatic acid metal salt is actively adhered to a portion of the surface of the toner particles, the portion having increased adhesiveness, and therefore, the adhesiveness between toner particles and the adhesiveness of toner particles to a transfer member may be reduced. When the adhesiveness between toner particles and the adhesiveness of toner particles to a transfer member are reduced, it is estimated that the toner particles easily rise uniformly when the toner is subjected to a transfer electric field. As a result, it is estimated that toner particles are arranged such that the long axis side of the toner faces the surface of a recording medium even when the toner is subjected to physical stress. Specifically, it is considered that a flake shape toner, in which the average circle equivalent diameter D of the toner particles is longer than the average C of a maximum thickness of the toner particles thereof, is configured such that the surface of the toner particles is polarized in $\delta^+$ and $\delta^-$ when it is subjected to physical stress in a developing device during the developing and transfer processes, and, on the other hand, aliphatic acid metal salt particles are easy to be unevenly distributed in the $\delta^-$ side of the surface of the toner particles due to positive charging properties. When a toner particle rises by receiving a transfer electric field, for example, in the case of a negatively charged toner, the toner particle rises in a state in which the $\delta^-$ polarized side of the surface of the toner is in contact with the surface of a transfer medium. In a transfer process, particularly, in a secondary transfer process, the aliphatic acid metal salt particles are adhered to the $\delta^-$ polarized side of the surface of the toner particles to reduce the adhesiveness between toner particles and the transfer medium, and thus the toner is easily aligned and raised on a transfer medium. Further, it is estimated that, since the adhesiveness between the transfer medium and the toner particles is reduced, it is possible to arrange (align) the toner particles on the transfer medium without breaking the alignment of the toner particles. Therefore, it is estimated that, since the toner particles are unlikely to aggregate even when it is subjected to physical stress over time, it is possible to align the toner particles such that the long axis side of the toner particle faces the surface of a recording medium, and it is possible to realize the uniformity of brilliance.

Hereinafter, each component constituting the toner and the physical properties thereof will be described.

In the electrostatic charge image developing toner according to the exemplary embodiment, the average circle equivalent diameter D of the toner is longer than the average C of a maximum thickness thereof.

In the flake surface in which a projected area is a majority of the surface, the circle equivalent diameter M is expressed by the following equation when the projected area is set to X.

$$M=2\times(X/\pi)^{1/2}$$

It is preferable that the brilliant toner according to the exemplary embodiment further satisfies the following requirement (1).

(1) In the case of observing the cross-section of the toner particle in the thickness direction thereof, the number of particles of the metallic pigment arranged so that an angle between a long axis direction in the cross section of the toner particle and a long axis direction of a particle of the metallic pigment is in a range of −30° to +30° is equal to or greater than 70% of the total number of particles of the metallic pigment.

Figure 2:
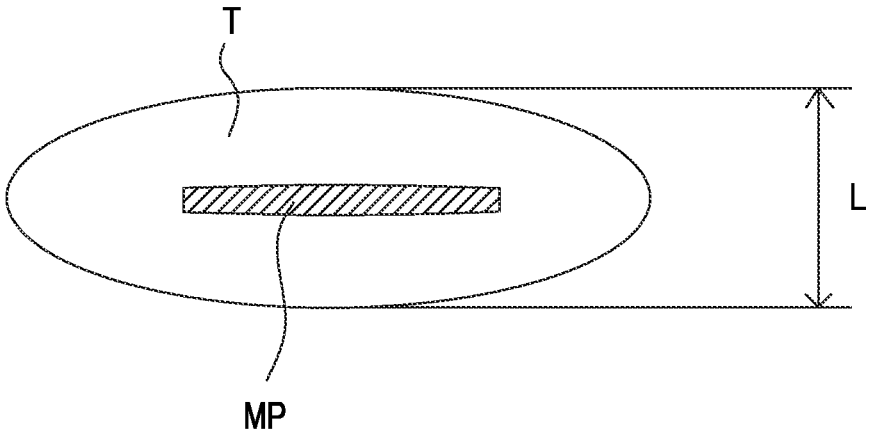
FIG. 2 is a cross-sectional view schematically showing an example of the electrostatic charge image developing toner according to the exemplary embodiment.

Here, FIG. 2 shows a cross-sectional view schematically illustrating an example of a toner particle in the electrostatic charge image developing toner satisfying the above requirement (1). Further, the schematic view shown in FIG. 2 is a cross-sectional view in the thickness direction of the toner particle.

The toner particle T shown in FIG. 2 is a flake shape toner particle whose circle equivalent diameter is longer than thickness L, and contains flake shape metallic pigment MP.

Average C of Maximum Thickness and Average Circle Equivalent Diameter D of Toner Particle As described above, the toner particle has a flake shape. That is, the value of average C of a maximum thickness of the toner particles is smaller than that of average circle equivalent diameter D.

The value of the ratio (C/D) of the toner particle is preferably 0.700 or less, more preferably from 0.001 to 0.500, further preferably from 0.010 to 0.200, and particularly preferably from 0.050 to 0.100. When the ratio (C/D) is 0.001 or more, the strength of the toner particles is secured, the fracture due to stress at the time of image formation is prevented, and the deterioration of charging due to the exposure of pigment from the toner particle and the fogging caused by this result are prevented. Further, when the ratio (C/D) is 0.700 or less, high brilliance is easily obtained compared to when the ratio (C/D) is more than 0.700.

The average C of a maximum thickness C and the average circle equivalent diameter D are measured by the following method.

The toner is placed on the smooth surface, and is dispersed by vibrations such that unevenness does not occur. One hundred toners are magnified to 1,000 times by a color laser microscope "VK-9700" (manufactured by Keyence Corporation) to measure the maximum thickness C and the circle equivalent diameter D calculated from the projected area of the plane as seen from above, and the arithmetic mean values thereof are obtained, respectively.

Similarly, average long axis length and average short axis length (for example, R1 and R2 shown in FIG. 1) are calculated by magnifying one hundred toners 1,000 times by a color laser microscope "VK-9700" (manufactured by Keyence Corporation) to measure the long axis lengths and the short axis lengths and obtaining the arithmetic mean values thereof.

As described above, in the exemplary embodiment, it is considered that the flake shape toner particles are arranged by the physical pressure from a fixing member in the fixing process such that the flake-shaped side faces the surface of a recording medium (in a direction nearly parallel to the surface thereof).

As described in the above (1), in the electrostatic charge image developing toner, it is preferable that, in the case of observing the cross-section of the toner in the thickness direction thereof, the number of particles of the metallic pigment arranged so that an angle between a long axis direction in the cross section of the toner particle and a long axis direction of a particle of the metallic pigment is in a range of −30° to +30° (referred to as "the number of flake shape pigments") is equal to or greater than 70% of the total number of particles of the metallic pigment.

The toner T shown in FIGS. 1 and 2 is a flake shape toner having a circle equivalent diameter longer than the thickness L, and contains a flake shape metallic pigment MP.

As shown in FIG. 2, when the toner T is a flake shape toner having a circle equivalent diameter longer than the thickness L, it is considered that the flake shape toner is disposed on a recording medium, to which the toner is finally transferred, such that the flake shape side thereof faces the surface of the recording medium. Further, even in the fixing process of image formation, it is considered that the flake shape toner is disposed by pressure at the time of fixation such that the flake shape side thereof faces the surface of the recording medium.

As described above, in the case of observing the cross-section of the toner particles in the thickness direction thereof, the number of particles of the metallic pigment arranged so that an angle between a long axis direction in the cross section of the toner particles and a long axis direction of a particle of the metallic pigment is in a range of −30° to +30° is preferably equal to or greater than 70%, more preferably from 75% by number to 95% by number, and particularly preferably from 80% by number to 90% by number.

It is preferable that the number of such a particle of the metallic pigment is 70% by number or more in the viewpoint of providing excellent uniformity of luster and an image having brilliance.

Herein, a method of observing a cross section of a toner will be described.

The toner particles are embedded using a bisphenol A-type liquid epoxy resin and a curing agent, and then a sample for cutting is prepared. Thereafter, the sample for cutting is cut at −100° C. using a cutting machine with a diamond knife (a LEICA Ultramicrotome (manufactured by Hitachi High-Technologies Corporation) is used in the exemplary embodiment), thereby preparing a sample for observation. With respect to the observation sample, the cross section of the toner particle is observed with a transmission electron microscope (TEM) at around 5,000 times magnification. With respect to each of the observed 100 toner particles, the number of pigment particles arranged so that the angle formed by the long axis direction of the toner particle in the cross section and the long axis direction of a pigment particle is in the range of −30° to +30° is counted using an image analysis software, and the proportion thereof is calculated.

The term "long axis direction of toner in the cross section" refers to a direction orthogonal to a thickness direction of toner having an average equivalent-circle diameter D larger than the average C of a maximum thickness, and the term "long axis direction of a pigment particle" refers to a length direction of the pigment particle.

In the toner for developing an electrostatic charge image of the exemplary embodiment, when a solid image of the toner is formed, a ratio (A/B) of a reflectance A at a light receiving angle of +30° to a reflectance B at a light receiving angle of −30°, which are reflectances measured when the image is irradiated with incident light at an incident angle of −45° using a goniophotometer, is preferably from 2 to 100.

If the ratio (A/B) is equal to or greater than 2, this indicates that light is reflected more toward a side ("angle+" side) opposite to the light incident side than toward a side ("angle−" side) where the incident light enters, that is, this indicates that diffuse reflection of the incident light is inhibited. When the diffuse reflection in which the incident light is reflected to various directions is caused, if the reflected light is visually checked, colors look blurry. Therefore, when the ratio (A/B) is not less than 2, if the reflected light is visually checked, brilliance is confirmed, thereby providing more excellent brilliant properties. On the other hand, when the ratio (A/B) is 100 or less, a viewing angle in which the reflected light may be visually checked is not narrowed too much. Therefore, a phenomenon in which colors look darkish depending on angles is not liable to be caused.

The ratio (A/B) is preferably from 20 to 90, more preferably from 40 to 80.

Measurement of Ratio (A/B) Using Goniophotometer

First, an incident angle and a light receiving angle will be described. In the exemplary embodiment, when the measurement is performed using a goniophotometer, the incident angle is set to −45°. This is because the sensitivity of the measurement is high with respect to images of a wide range of brilliance.

In addition, the reason why the light receiving angle is set to −30° and +30° is that the sensitivity of the measurement is the highest for evaluating images having and not having the impression of brilliance.

Next, the method of measuring the ratio (A/B) will be described.

In the exemplary embodiment, when the ratio (A/B) is measured, first, a "solid image" is formed. The "solid image" refers to an image of 1000 printing rate.

By using a goniospectrocolorimeter GC5000L manufactured by NIPPON DENSHOKU INDUSTRIES CO., LTD. as a goniophotometer, incident light that enters the solid image at an incident angle of −45° enters the image portion of the formed solid image, and the reflectance A at a light receiving angle of +30° and the reflectance B at a light receiving angle of −30° are measured. The reflectances A and B are measured with respect to light having a wavelength ranging from 400 nm to 700 nm at an interval of 20 nm, and the average value of the reflectance at each wavelength is calculated. The ratio (A/B) is calculated from the measurement results.

External Additive

The toner of the exemplary embodiment contains an aliphatic acid metal salt particle as an external additive, and the content of the aliphatic acid metal salt particle is from 0.1 parts by weight to 2.0 parts by weight, with respect to 100 parts by weight of the toner.

In the toner of the exemplary embodiment, the content of the aliphatic acid is from 0.1 parts by weight to 2.0 parts by weight, preferably from 0.1 parts by weight to 1.5 parts by weight, and more preferably from 0.2 parts by weight to 1.0 part by weight, with respect to 100 parts by weight of the toner. When the content thereof is within the above range, the uniformity of brilliance in the obtained image is more excellent even under physical stress.

Further, when the content of the aliphatic acid metal salt particle with respect to 100 parts by weight of the toner is less than 0.1 parts by weight, it is estimated that, since the amount of the aliphatic acid metal salt particle is small, it is difficult to uniformly adhere the aliphatic acid metal salt particles to the $\delta^-$ surface of the particles, and, as a result, the uniformity of brilliance is deteriorated. On the other hand, when the content of the aliphatic acid metal salt particle is larger than 2.0 parts by weight, it is estimated that, since the amount of the aliphatic acid metal salt particle is large, the transfer electric field is scattered, and, as a result, the uniformity of brilliance is deteriorated.

Here, in the measurement of the content of the aliphatic acid metal salt particle with respect to 100 parts by weight of the toner, an aliphatic acid is specified by the NMR analysis of the moiety of an aliphatic acid in the aliphatic acid metal salt particle of the toner, and the content of metal (for example, zinc) in the toner is determined by fluorescent X-ray analysis, thus measuring the aliphatic acid metal salt equivalent amount.

Further, in the toner of the exemplary embodiment, the content of particles having a particle diameter of 25 μm or more in the aliphatic acid metal particles is preferably 0.5 parts by weight or less, more preferably from 0.1 parts by weight to 0.5 parts by weight, and further preferably from 0.2 parts by weight to 0.4 parts by weight, with respect to 100 parts by weight of the toner. When the content thereof is within the above range, the uniformity of brilliance in the obtained image is more excellent even under physical stress.

Here, the particle diameter of the aliphatic acid metal salt particle is measured using the Multisizer II (manufactured by Beckman-Coulter Corporation). In this case, when the measuring object is a particle having a particle diameter of from 3 μm to 20 μm, the particle diameter of the aliphatic acid metal salt particle is measured using an aperture tube having a diameter of 100 μm, and, when the measuring object is a particle having a particle diameter of from 20 μm to 100 μm, the particle diameter thereof is measured using an aperture tube having a diameter of 200 Hereinafter, the method of obtaining the content of the particle having a particle diameter of 25 μm or more in the aliphatic acid metal salt particle will be described.

First, 1 g of the toner of the exemplary embodiment is put into a 1 L beaker, and 500 g of an aqueous solution in which 2% by weight of sodium dodecylbenzene sulfonate is dissolved in ion-exchange water is added thereto. Thereafter, the resultant is put into an ultrasonic cleaner to perform a dispersion treatment to disperse the particles to be measured, and then toner and aliphatic acid metal salt particles are separated from each other by a centrifugal separator. Since the density of the aliphatic acid metal salt particles is less than 1 and the density of the toner is generally 1 or more, a supernatant is removed from the obtained liquid, to thereby obtain the diameter of this particle. Specifically, the content of particles having a particle diameter of 25 μm is obtained from the sum of volume percentages measured by channels of 25.398 μm in the channels having the particle diameter (16 channels of from 1.587 μm to 64 μm) measured by the Multisizer II.

Further, the volume average particle size of the aliphatic acid metal salt particles may also be obtained by the above-mentioned method.

The aliphatic acid metal salt particle used in the exemplary embodiment is a particle of a salt composed of an aliphatic acid and a metal.

As the aliphatic acid, both saturated aliphatic acids and unsaturated aliphatic acids may be used, but preferably aliphatic acids having a carbon number of from 10 to 25, and more preferably aliphatic acids having a carbon number of from 14 to 24. If the carbon number is within the above range, when physical stress is applied to the transfer medium such that the $\delta^-$ polarized side of the toner particle is pressed, the aliphatic acid metal salt particle is easily entangled and adhered to the surface of a toner. Further, when the aliphatic acid metal salt particle is adhered to the $\delta^-$ polarized side of the surface of a toner particle, since the adhesiveness of the transfer medium is easily lowered, the lubricating effects as an external additive may be sufficiently achieved, and the uniformity of brilliance in the obtained image is more excellent even under physical stress.

Examples of the saturated aliphatic acids include lauric acid, stearic acid, and behenic acid, and stearic acid is preferable.

Examples of the unsaturated aliphatic acids include oleic acid and linoleic acid.

Examples of the metal include aluminum, lithium, copper, lead, nickel, strontium, cobalt, sodium, manganese, iron, magnesium, calcium, barium, and zinc.

Further, as the metal, a divalent metal is preferable, magnesium, calcium, aluminum, barium, or zinc is more preferable, magnesium, calcium, or zinc is further preferable, magnesium or zinc is particularly preferable, and zinc is most preferable. According to the above aspect, the positive charging properties of the aliphatic acid metal salt particles are excellent, the aliphatic acid metal salt particles are easily adhered to the $\delta^-$ surface of the particle of the toner, and the uniformity of brilliance in the obtained image is more excellent even under physical stress.

Examples of the aliphatic acid metal salt in the aliphatic acid metal salt particles include aluminum stearate, calcium stearate, potassium stearate, magnesium stearate, barium stearate, lithium stearate, zinc stearate, copper stearate, lead stearate, nickel stearate, strontium stearate, cobalt stearate, sodium stearate, zinc oleate, manganese oleate, iron oleate, aluminum oleate, copper oleate, magnesium oleate, calcium oleate, zinc palmitate, cobalt palmitate, copper palmitate, magnesium palmitate, aluminum palmitate, calcium palmitate, zinc laurate, manganese laurate, calcium laurate, iron laurate, magnesium laurate, aluminum laurate, zinc linoleate, cobalt linoleate, calcium linoleate, zinc ricinoleate, and aluminum ricinoleate.

The aliphatic acid metal salt is preferably an aliphatic acid metal salt composed of at least one aliphatic acid aliphatic acid selected from the group consisting of stearic acid and lauric acid and at least one metal selected from the group consisting of magnesium, calcium and zinc.

Further, as the aliphatic acid metal salt particle, from the viewpoint of fluidity, fixability and the like, an aliphatic acid metal salt particle having a melting point of from 40° C. to 200° C. is preferable, a zinc stearate particle, a zinc laurate particle, or a magnesium stearate particle is more preferable, a zinc stearate particle or a magnesium stearate is further preferable, and a zinc stearate particle is particularly preferable.

The volume average particle diameter of the aliphatic acid metal salt particles is preferably from 1 μm to 25 μm, more preferably from 2 μm to 20 μm, and further preferably from 5 μm to 15 μm.

Further, the aliphatic acid metal salt particles may be used alone or in combination of two or more thereof.

The method of preparing an aliphatic acid metal salt is not particularly limited, and a known method may be used. As the method, a method of cationically substituting an aliphatic acid alkali metal salt or a method of directly reacting aliphatic acid with metal hydroxide is exemplified. For example, as the method of preparing zinc stearate, a method of cationically substituting sodium stearate or a method of reacting stearic acid with zinc hydroxide is exemplified.

Further, these aliphatic acid metal salts may be formed into particles by a known method.

The toner of the exemplary embodiment may contain particles other than the above aliphatic acid metal salt particles as the external additive.

As the particles other than the above aliphatic acid metal salt particles, inorganic particles or organic particles are exemplified, and inorganic particles are preferable.

Examples of the inorganic particles include silica, alumina, titanium oxide, metatitanic acid, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride.

Among these, titanium compound particles are preferable, titanium oxide and/or meta-titanic acid particles are more preferable, and meta-titanic acid particles are particularly preferable.

It is preferable that the surface of the inorganic particle is previously hydrophobized. When the inorganic particle is previously hydrophobized, the leakage of charges of the toner particle is prevented, and $\delta^+$ and $\delta^-$ polarizations are formed on the surface of the toner particle, thus obtaining the effects of the invention.

The hydrophobization treatment may be performed by dipping the inorganic particle into a hydrophobizing agent. The hydrophobizing agent is not particularly limited, but examples thereof include a silane coupling agent, silicone oil, a titanate coupling agent, and an aluminum coupling agent. These hydrophobizing agents may be used alone or in combination of two or more thereof. Among these, a silane coupling agent is preferable.

Organic particles are generally used for the purpose of improving cleaning properties and transfer properties. Specific examples of organic particles include fluorine resin powder, such as polyvinylidene fluoride and polytetrafluoroethylene, polystyrene, and polymethyl methacrylate.

The number average primary particle size of the particles other than aliphatic acid metal salt particles is preferably from 1 nm to 300 nm, more preferably from 10 nm to 200 nm, and further preferably from 15 nm to 180 nm.

Further, the particles other than aliphatic acid metal salt particles may be used alone or in combination of two or more thereof.

The amount of the particles other than aliphatic acid metal salt particles in the toner of the exemplary embodiment is preferably in a range of from 0.01 parts by weight to 5 parts by weight, and more preferably in a range of from 0.1 parts by weight to 3.5 parts by weight, with respect to 100 parts by weight of the toner.

Metallic Pigment

The toner of the exemplary embodiment includes a toner particle containing a binder resin and a metallic pigment.

Examples of the metallic pigment used in the electrostatic charge image developing toner of the exemplary embodiment include metal powders such as aluminum, brass, bronze, nickel, stainless steel, zinc, copper, silver, gold, and platinum; metal powder on which the metal is deposited, and metal-deposited flaky glass powder. Among these metallic pigments, particularly, aluminum is most preferable from the viewpoint of being readily available and easily making a toner particle to have a flake shape. The surface of the metallic pigment may be coated with silica particles, an acrylic resin, or a polyester resin. The shape of the metallic pigment is preferably flake-shape (flat) or tabular, and more preferably flake-shape. Further, preferably, the metallic pigment is configured such that the average circle equivalent diameter of the metallic pigment is longer than the average of a maximum thickness of the toner particles thereof.

These metallic pigments may be used alone or in combination of two or more thereof.

The content of the metallic pigment in the electrostatic charge image developing toner of the exemplary embodiment is preferably from 1 part by weight to 70 parts by weight, and more preferably from 5 parts by weight to 50 parts by weight, with respect to 100 parts by weight of the total amount of the toner.

Preferably, the metallic pigment used in the exemplary embodiment is surface-treated, more preferably the metallic pigment is a pigment having a coating layer, and further preferably the metallic pigment has a first coating layer containing at least one metal oxide selected from the group consisting of silica, alumina and titania, which covers the surface of the metallic pigment, and a second coating layer covering the surface of the first coating layer.

The surface treatment method of the metallic pigment is not particularly limited, and a known surface treatment method is used as the surface treatment thereof. However, the method of forming the first coating layer and the second coating layer using the following method is preferably exemplified.

The first coating layer contains at least one metal oxide selected from the group consisting of silica, alumina and titania, and these metal oxides may be used alone or in combination of two or more thereof.

Among the above, the metallic pigment is excellent in chemical resistance at the time of preparing toner particles. Further, silica is preferable in that the first coating layer covers the surface of the metallic pigment in a more nearly uniform state.

Here, the first coating layer may be formed of only the above metal oxide, but may contain impurities produced in the preparation of the metallic pigment.

In the metallic pigment, the element ratio (molar ratio) Mb/Ma of metal Mb in the first coating layer to metal Ma in the metallic pigment is preferably from 0.08 to 0.20. When the element ratio Mb/Ma is 0.20 or less, an image having excellent brilliance is formed without deteriorating the reflectance of light due to the first coating layer. Further, when the element ratio Mb/Ma is 0.08 or higher, the surface of the metallic pigment is uniformly coated, and thus the transfer properties at high temperature and high humidity are improved.

The element content at the time of obtaining the element ratio Mb/Ma is measured using an X-ray fluorescence analyzer (XRF).

Specifically, the element content is measured as follows. First, a compression pressure of 10 tons is applied to 5 g of toner particles using a pressure forming machine to fabricate a disk having a diameter of 5 cm, and this disk is used as a measuring sample. Then, the content of metal elements in the metallic pigment and the first coating layer is measured using an X-ray fluorescence analyzer (XRF-1500) manufactured by Shimadzu Corporation under measurement conditions of a tube voltage of 40 KV, a tube current of 90 mA, and a measuring time of 30 minutes.

Examples of the method of coating the surface with metal oxide include a method of forming a coating layer of metal oxide on the surface of the metallic pigment by a sol-gel process and a method of forming a coating layer of metal oxide by depositing metal hydroxide on the surface of the metallic pigment and crystallizing the deposited metal oxide at low temperature.

In the exemplary embodiment, it is preferable that an organic metal compound is added such that the element ratio Mb/Ma is from 0.08 to 0.20, and a hydrolysis catalyst is added into a metallic pigment-containing dispersion to adjust the pH of the dispersion, thereby depositing metal hydroxide on the surface of the metallic pigment.

The coated amount of the first coating layer is preferably 10% by weight to 40% by weight, and more preferably 20% by weight to 30% by weight, based on the weight of the metallic pigment.

In addition, the coated amount of the first coating layer is measured by a calibration curve which is obtained by previously measuring a mixture of an alumina pigment and silica particles using an X-ray fluorescence analyzer (XRF).

It is preferable that the metallic pigment has the first coating layer and a second coating layer.

It is preferable that the second coating layer contains a resin (also referred to as a second binder resin).

As the second binder resin to be used herein, resins known as the binder resins for the toner particles described below, such as acrylic resin and polyester resin, are used.

Among these, an acrylic resin is preferable from the viewpoint of uniformly coating the surface of pigment.

In addition, the second coating layer is preferably a layer which contains a cross-linked resin from the viewpoint of excellent chemical resistance in the production of the toner particles or impact resistance.

Here, the second coating layer may contain only the above resin, but may contain impurities contained in the preparation.

The coated amount of the second coating layer is preferably 5% by weight to 30% by weight, more preferably 10% by weight to 25% by weight, and further preferably 15% by weight to 20% by weight, based on the weight of the metallic pigment. When the coated amount of the second coating layer is 5% by weight or more, the coatability of the metallic pigment by the binder resin is maintained, and thus the deterioration of transfer properties at high temperature and high humidity is prevented. Further, when the coated amount of the second coating layer is 20% by weight or less, the deterioration of specular reflectance by the resin constituting the second coating layer is prevented, and thus an image having excellent brilliance is formed.

In addition, the coverage of the second coating layer is measured by the mass reduction rate obtained when temperature is increased from 30° C. to 600° C. at a heating rate of 30° C./min under a nitrogen stream, using a thermogravimetric analyzer (TGA).

In addition, when the coated amount of the second coating layer in the metallic pigment in the toner particles is measured, components such as the binder resin (and a release agent and other components) are removed from the toner particles by dissolution, firing, or the like, and then the above-mentioned method may be applied.

Further, since a release agent and other components are mixed in the binder resin in the toner particles, the coated amount of the second coating layer may be measured by distinguishing the second coating layer in the metallic pigment from the mixed area of these components.

The second coating layer is formed as follows.

That is, the solid-liquid separation of the metallic pigment provided with the first coating layer is performed; if necessary, cleaning is performed; the cleaned metallic pigment is dispersed in a solvent; a polymerizable monomer and a polymerization initiator are added with stirring; and heating treatment is performed, to thereby deposit a resin on the surface of the metallic pigment. In this way, the second coating layer is formed.

Binder Resin

The toner of the exemplary embodiment includes a toner particle containing a binder resin and a metallic pigment.

Examples of the binder resins include a homopolymer consisting of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a vinyl resin formed of a copolymer obtained by combining two or more kinds of these monomers.

Examples of the binder resin include a non-vinyl resin such as an epoxy resin, a polyester resin, a polyurethane resin, a polyamide resin, a cellulose resin, a polyether resin, and a modified rosin, a mixture of these and a vinyl resin, or a graft polymer obtained by polymerizing a vinyl monomer in the presence thereof.

These other binder resins may be used alone or in combination of two or more kinds thereof.

As the binder resin, a polyester resin is preferable.

As the polyester resin, a well-known polyester resin is used, for example.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Among these, for example, aromatic diols and alicyclic dials are preferably used, and aromatic diols are more preferably used as the polyol.

As the polyol, a tri- or higher-valent polyol employing a crosslinked structure or a branched structure may be used in combination with a diol. Examples of the tri- or higher-valent polyol include glycerin, trimethylolpropane, and pentaerythritol.

The polyols may be used alone or in combination of two or more kinds thereof.

The glass transition temperature (Tg) of the amorphous polyester resin is preferably from 50° C. to 80° C., and more preferably from 50° C. to 65° C.

The glass transition temperature is determined by a DSC curve obtained by differential scanning calorimetry (DSC). More specifically, the glass transition temperature is determined by "extrapolating glass transition starting temperature" disclosed in a method of acquiring the glass transition temperature of JIS K7121-1987 "Testing Methods for Transition Temperatures of Plastics".

A weight average molecular weight (Mw) of the polyester resin is preferably from 5,000 to 1,000,000, and more preferably from 7,000 to 500,000.

A number average molecular weight (Mn) of the polyester resin is preferably from 2,000 to 100,000.

A molecular weight distribution Mw/Mn of the polyester resin is preferably from 1.5 to 100, and more preferably from 2 to 60.

The weight average molecular weight and the number average molecular weight are measured by gel permeation chromatography (GPC). The molecular weight measurement by GPC is performed with a THF solvent using a GPC•HLC-8120 GPC manufactured by Tosoh Corporation as a measurement device and a TSKgel Super HM-M column (15 cm) manufactured by Tosoh Corporation. The weight average molecular weight and the number average molecular weight are calculated from results of this measurement using a calibration curve of molecular weights created with monodisperse polystyrene standard samples.

The polyester resin is obtained with a well-known preparing method. Specific examples thereof include a method of conducting a reaction at a polymerization temperature set to 180° C. to 230° C., if necessary, under reduced pressure in the reaction system, while removing water or alcohol formed during condensation.

When monomers of the raw materials do not dissolve or become compatibilized at a reaction temperature, a high-boiling-point solvent may be added as a solubilizing agent to dissolve the monomers. In this case, a polycondensation reaction is conducted while distilling away the solubilizing agent. When a monomer having poor compatibility is present in a copolymerization reaction, the monomer having poor compatibility and an acid or an alcohol to be polycondensed with the monomer may be previously condensed and then polycondensed with a major component.

The content of the binder resin is, for example, preferably from 40% by weight to 95% by weight, more preferably from 50% by weight to 90% by weight, and even more preferably from 60% by weight to 85% by weight, with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

As the release agent, for example, ester wax, polyethylene, polypropylene, or a copolymer of polyethylene and polypropylene is preferable, but specific examples thereof include: unsaturated aliphatic acids, such as polyglycerin wax, microcrystalline wax, paraffin wax, carnauba wax, sasol wax, montanic acid ester wax, deoxidized carnauba wax, palmitic acid, stearic acid, montanic acid, bransinic acid, eleostearic acid, and barinaric acid; saturated alcohols, such as stearyl alcohol, aralkyl alcohol, biphenyl alcohol, carnaubyl alcohol, glyceryl alcohol, melisyl alcohol, and long-chain alkyl alcohols having an long-chain alkyl group; polyols such as sorbitol; aliphatic acid amides, such as amide linoleate, amide oleate, and amide laurate; saturated aliphatic acid bis-amides, such as methylene-bis-stearic acid amide, ethylene-bis-capric acid amide, ethylene-bis-lauric acid amide, and hexamethylene-bis-stearic acid amide; unsaturated aliphatic acid amides, such as ethylene-bis-oleic acid amide, hexamethylene bis-oleic acid amide, N,N'-dioleoyl adipic acid amide, and N,N'-dioleylsebacic acid amide; aromatic bisamides, such as m-xylene bis-stearic acid amide, N,N'-distearyl isophthalic acid amide; aliphatic acid metal salts (generally referred to as metal soaps), such as calcium stearate, calcium laurate, zinc stearate, and magnesium stearate; waxes obtained by grafting vinyl monomers such as styrene or acrylic acid to aliphatic hydrocarbon waxes; products of partial esterification of aliphatic acids, such as behenic acid monoglyceride, and polyols; and methyl ester compounds having a hydroxyl group obtained by the hydrogenation of vegetable oil.

These release agents may be used alone or in combination of two or more thereof.

The content of the release agent is preferably in a range of from 1% by weight to 20% by weight, and more preferably in a range of from 3% by weight to 15% by weight with respect to 100% by weight of the binder resin. When the content thereof is within the above range, it is possible to achieve both good fixing properties and image quality characteristics.

Other Colorants

The toner of the exemplary embodiment, if necessary, may include other colorants other than metallic pigment.

As other colorants, known colorants may be used. Any colorant may be selected from the view point of hue angle, colorfulness, brightness, weather resistance, OHP permeability, and dispersibility in the toner.

Specific examples of other colorants include: various pigments, such as Watching Red, Permanent Red, Brilliant Carmine 3B, Brilliant Carmine 6B, Du Pont Oil Red, Pyrazolone Red, Lithol Red, Rhodamine B Lake, Lake Red C Rose Bengal; and various colorants, such as acridine, xanthene, azo, benzoquinone, azine, anthraquinone, thioindigo, dioxazine, thiazine, azomethine, indigo, thioindigo, phthalocyanine, aniline black, polymethine, triphenylmethane, diphenylmethane, thiazine, thiazole, and xanthenes colorants In addition, specific examples of other colorants include carbon black, nigrosine dye (CINo. 50415B), aniline blue (CINo. 50405), calco oil blue (CINo.azoic Blue3), chrome yellow (CINo. 14090), ultramarine blue (CINo. 77103), Dupont oil red (CINo. 26105), quinoline yellow (CINo. 47005), methylene blue chloride (CINo. 52015), phthalocyanine blue (CINo. 74160), malachite green oxalate (CINo. 42000), lamp black (CINo. 77266), Rose Bengal (CINo. 45435), and mixtures thereof, which are preferably used.

The amount of other colorants used is preferably from 0.1 parts by weight to 20 parts by weight, and more preferably from 0.5 parts by weight to 10 parts by weight, with respect to 100 parts by weight of the toner. As the colorant, these pigments or dyes may be used alone or in combination of two or more thereof.

As the method of dispersing other colorants, any method of general dispersing methods, such as a rotary-shearing homogenizer, a ball mill having a medium, a sand mill, and a dyno mill, may be used, and this method is not limited thereto. These colorant particles may be added to the mixed solvent at once together with other particle components, and may also be divided and added in multiple stages.

Other Components

Various components, such as an internal additive, a charge controlling agent, inorganic powder (inorganic particles), and organic particles, other than the above components, may be added to the toner, if further necessary.

Examples of internal additives include magnetic materials, such as metals such as ferrite, magnetite, reduced iron, cobalt, nickel, and manganese, alloys thereof, and compounds containing these metals. When a magnetic toner containing this magnetic material is used, the average particle diameter of these ferromagnetic materials is preferably 2 μm or less, and more preferably from 0.1 μm to 0.5 μm. The content of the magnetic material in the toner is preferably from 20 parts by weight to 200 parts by weight, and more preferably 40 parts by weight to 150 parts by weight, with respect to 100 parts by weight of resin components. Further, in the magnetic properties in 10K oersted applied, preferably, magnetic coercive force (Hc) is from 20 oersted to 300 oersted, saturated magnetization (σs) is from 50 emu/g to 200 emu/g, and remnant magnetization (σr) is from 2 emu/g to 20 emu/g.

Examples of the charge-controlling agent include a fluorine surfactant, a salicylic acid metal complex, a metal-containing dye such as an azo metal compound, a polymeric acid such as a polymer containing maleic acid as a monomer component, quaternary ammonium salt, and an azine dye such as nigrosine.

The toner may contain inorganic powder for the purpose of adjusting viscoelasticity. Examples of inorganic powder include all of the inorganic particles used as external additives for normal toner surface, such as silica, alumina, titania, calcium carbonate, magnesium carbonate, calcium phosphate, and cerium oxide, which are exemplified in detail below.

Aspects and Physical Properties of Toner

Volume Average Particle Diameter of Toner Particles

The volume average particle diameter of toner particles is preferably from 1 μm to 30 μm, and more preferably from 10 μm to 20 μm. Here, in the case of the flake shape toner of the exemplary embodiment, the value of the volume average particle diameter represents the volume average value of sphere-equivalent diameters.

Specifically, in the definition of the volume average particle diameter $D_{50v}$, when the cumulative distribution of each of volume and number from the small diameter side is drawn with respect to the particle size range (channel) divided based on the particle size distribution measured by a measuring device such as Coulter Multisizer II (manufactured by Beckman-Coulter Corporation), the particle diameter at a cumulative of 16% is defined by volume $D_{16V}$ and number $D_{16P}$ the particle diameter at a cumulative of 50% is defined by volume $D_{50V}$ and number $D_{50P}$, and the particle diameter at a cumulative of 84% is defined by volume $D_{84V}$ and number $D_{84P}$. The volume average particle size distribution index (GSDv) is calculated as $(D_{84v}/D_{16v})^{1/2}$ using these definitions.

In the measurement of the average particle diameter of particles such as the toner particles, Coulter Multisizer II (manufactured by Beckman-Coulter Corporation) may be used. In this case, the average particle diameter of particles may be measured using an optimal aperture by the particle size level of particles. The particle diameter of particles measured in this way is expressed as volume average particle diameter.

When the particle diameter of a particle is about 5 μm or less, the particle diameter thereof may be measured using a laser diffraction scattering particle size distribution analyzer (LA-700, manufactured by HORIBA Ltd.).

Further, when the particle diameter thereof is in nanometers, the particle diameter thereof may be measured using a BET type specific surface area measuring device (Flow SorbII2300, manufactured by Shimadzu Corporation).

Method of Preparing Electrostatic Charge Image Developing Toner

Method of Preparing Toner

The electrostatic charge image developing toner according to the exemplary embodiment is prepared by a known method such as a wet method or a dry method, but, preferably, is prepared by a wet method. Examples of the wet method include a melting suspension method, an emulsion aggregating method, and a dissolution suspension method. Among these wet methods, it is particularly preferable that the electrostatic charge image developing toner is prepared by an emulsion aggregating method in terms of the shape and particle diameter of the toner particles being easily controlled and a control range of a structure of the toner particles, such as a core-shell structure, being wide.

Here, the emulsion aggregating method is a method including: respectively preparing dispersions (emulsion, metallic pigment dispersion, and the like) containing the components (binder resin, colorant, and the like) contained in the toner particles; mixing these dispersions to make a dispersion mixture containing aggregated particles; and heating the aggregated particles to the melting temperature or glass transition temperature of the binder resin or higher (in the case of preparing a toner particle containing both a crystalline resin and an amorphous resin, the melting temperature of the crystalline resin or higher, or the glass transition temperature of the amorphous resin or higher) to aggregate and coalesce toner components.

In the case of preparing the toner by the emulsion aggregation method, for example, the toner is preferably prepared by the following preparation method.

Emulsification Process

A resin particle dispersion may be prepared by a disperser applying a shearing force to a solution, in which an aqueous medium and a binder resin are mixed, to be emulsified, as well as by using well-known polymerization methods such as an emulsification polymerization method, a suspension polymerization method, and a dispersion polymerization method. At this time, particles may be formed by heating a resin component to lower the viscosity thereof. In addition, in order to stabilize the dispersed resin particles, a dispersant may be used. Furthermore, when the resin is dissolved in an oil solvent having relatively low solubility in water, the resin is dissolved in the solvent and particles thereof are dispersed in water with a dispersant and a polymer electrolyte, followed by heating and reduction in pressure to evaporate the solvent. As a result, the resin particle dispersion is prepared.

Examples of the aqueous medium include water such as distilled water or ion exchange water; and alcohols, and water is preferable.

In addition, examples of the dispersant which is used in the emulsification process include a water-soluble polymer such as polyvinyl alcohol, methyl cellulose, ethyl cellulose, hydroxyethyl cellulose, carboxymethyl cellulose, sodium polyacrylate, or sodium polymethacrylate; a surfactant such as an anionic surfactant (for example, sodium dodecylbenzenesulfonate, sodium octadecylsulfate, sodium oleate, sodium laurate, or potassium stearate), a cationic surfactant (for example, laurylamine acetate, stearylamine acetate, or lauryltrimethylammonium chloride), a zwitterionic surfactant (for example, lauryl dimethylamine oxide), or a nonionic surfactant (for example, polyoxyethylene alkyl ether, polyoxyethylene alkyl phenyl ether, or polyoxyethylene alkylamine); and an inorganic salt such as tricalcium phosphate, aluminum hydroxide, calcium sulfate, calcium carbonate, or barium carbonate.

Examples of the disperser which is used for preparing an emulsion include a homogenizer, a homomixer, a pressure kneader, an extruder, and a media disperser. With regard to the size of the resin particles, the average particle diameter (volume average particle diameter) thereof is preferably less than or equal to 1.0 μm, more preferably from 60 nm to 300 nm, and still more preferably from 150 nm to 250 nm. When the volume average particle diameter thereof is greater than or equal to 60 nm, the resin particles are likely to be stable in the dispersion and thus the aggregation of the resin particles may be prevented. In addition, when the volume average particle diameter thereof is less than or equal to 1.0 μm, the particle diameter distribution of the toner particles may be narrowed.

When a release agent particle dispersion is prepared, a release agent is dispersed in water with an ionic surfactant and a polyelectrolyte such as a polyacid or a polymeric base and the resultant is heated at a temperature higher than or equal to the melting point of the release agent, followed by dispersion using a homogenizer to which strong shearing force is applied or a pressure extrusion type disperser. Through the above-described process, a release agent particle dispersion is obtained. During the dispersion, an inorganic compound such as polyaluminum chloride may be added to the dispersion. Preferable examples of the inorganic compound include polyaluminum chloride, aluminum sulfate, high basic polyaluminum chloride (BAC), polyaluminum hydroxide, and aluminum chloride. Among these, polyaluminum chloride and aluminum sulfate are preferable. [The release agent particle dispersion is used in the emulsion aggregating method, but may also be used when the toner is prepared in the suspension polymerization method.]

Through the dispersion, the release agent particle dispersion containing release agent particles having a volume average particle diameter of 1 μm or less is obtained. It is more preferable that the volume average particle diameter of the release agent particles be from 100 nm to 500 nm. When the volume average particle diameter is greater than or equal to 100 nm, although also being affected by properties of the binder resin to be used, in general, it is easy to mix a release agent component into toner. In addition, when the volume average particle diameter is less than or equal to 500 nm, the dispersal state of the release agent in the toner may be satisfactory.

When a metallic pigment dispersion is prepared, a well-known dispersion method may be used. For example, general dispersion units such as a rotary-shearing homogenizer, a ball mill having a medium, a sand mill, a dyno mill, or an ultimizer are used, and the dispersion method is not limited thereto. The metallic pigment is dispersed in water with an ionic surfactant and a polyelectrolyte such as a polyacid or a polymeric base. The volume average particle diameter of the dispersed metallic pigment particles may be less than or equal to 20 μm. However, the volume average particle diameter of the dispersed metallic pigment particles is preferably in a range of from 3 μm to 16 μm because the metallic pigment is satisfactory dispersed in the toner without impairing aggregability.

The metallic pigment and the binder resin may be dispersed and dissolved in a solvent and mixed, and the resultant may be dispersed in water through phase inversion emulsification or shearing emulsification, thereby preparing a dispersion of the metallic pigment coated with the binder resin.

Aggregation Process

In the aggregation process, the resin particle dispersion, the metallic pigment dispersion, the release agent dispersion and the like are mixed to obtain a mixture and the mixture is heated at the glass transition temperature or less of the resin particles and aggregated to form aggregated particles. In most cases, the aggregated particles are formed by adjusting the pH value of the mixture to be acidic under stirring. Under the above-described stirring conditions, the ratio (C/D) may be readily adjusted to be in a preferable range. Specifically, by performing the stirring faster and applying heat in the stage of forming aggregated particles, the ratio (C/D) may be decreased. In addition, by performing the stirring slower and applying heat at a low temperature, the ratio (C/D) may increase. The pH value is preferably from 2 to 7. At this time, use of a coagulant is also effective.

In the aggregation process, the release agent dispersion and other various dispersions such as the resin particle dispersion may be added and mixed at once or may be added many times in separate portions.

As the coagulant, a surfactant having a reverse polarity to that of a surfactant which is used as the dispersant, an inorganic metal salt, and a divalent or higher valent metal complex may be preferably used. In particular, the metal complex is particularly preferable because the amount of the surfactant used may be reduced and charging characteristics are improved.

Preferable examples of the inorganic metal salt include an aluminum salt and a polymer thereof. In order to obtain a narrower particle diameter distribution, a divalent inorganic metal salt is preferable to a monovalent inorganic metal salt, a trivalent inorganic metal salt is preferable to a divalent inorganic metal salt, and a tetravalent inorganic metal salt is preferable to a trivalent inorganic metal salt. Even in a case of inorganic metal salts having the same valence, a polymeric type of inorganic metal salt polymer is more preferable.

In the exemplary embodiment, in order to obtain a narrower particle diameter distribution, a tetravalent inorganic metal salt polymer containing aluminum is preferably used.

After the aggregated particles have desired particle diameters, the resin particle dispersion is additionally added (coating process). According to this, a toner having a configuration in which the surfaces of core aggregated particles are coated with resin may be prepared. In this case, the release agent and the metallic pigment are not easily exposed to the surface of the toner, which is preferable from the viewpoints of charging characteristics and developability. In a case of additional addition, a coagulant may be added or the pH value may be adjusted before additional addition.

Coalescence Process

In the coalescence process, under stirring conditions based on those of the aggregation process, by increasing the pH value of a suspension of the aggregated particles to be in a range of from 3 to 9, the aggregation is stopped. By performing heating at the glass transition temperature or higher of the resin, the aggregated particles are coalesced.

Further, when the aggregated particles are coated with the resin, this resin is also coalesced to cover core aggregated particles. The heating may be performed to a degree of melting, or may be performed for about from 0.5 hours to 10 hours.

The aggregated particles are coalesced and then cooled to obtain coalesced particles. In the cooling process, the crystallization of the coalesced particles may be accelerated by dropping the cooling rate to around the glass transition temperature of the resin (in the range of the glass transition temperature±10° C.), by the so-called slow cooling.

The obtained coalesced particles are formed into toner particles through a solid-liquid separation process, or, if necessary, by a cleaning process or a drying process.

The toner according to the exemplary embodiment, for example, is prepared by adding an external additive to the obtained dried toner particles and mixing the external additive with the toner particles. Preferably, the mixing is performed by a V-blender, a Henschel mixer, or a lady gate mixer. Further, if necessary, coarse toner particles may be removed using a vibration classifier or a wind classifier.

The method of applying an external additive to the surface of toner particle is not particularly limited, and, as the method, a known method, such as a method of sticking the external additive to the surface of toner particle with a mechanical process or a chemical process, is exemplified.

Electrostatic Charge Image Developer

The electrostatic charge image developer (hereinafter, referred to as "developer") according to the exemplary embodiment is not particularly limited as long as it contains the electrostatic charge image developing toner according to the exemplary embodiment. This electrostatic charge image developer may be a one-component developer using a toner alone, and may also be a two-component developer containing a toner and a carrier. Here, the one-component developer may be a toner containing magnetic metal particles, and may also be a non-magnetic one-component toner containing no magnetic metal particles.

The carrier is not particularly limited as long as it is a known carrier. As the carrier, an iron powder carrier, a ferrite carrier, or a surface-coated ferrite carrier is used. Further, each surface additive powder may be used after subjected to the desired surface treatment.

Specific examples of the carrier include resin-coated carriers below. As the core particles of the carrier, normal iron powder particles, ferrite particles, and magnetite molding particles are exemplified. The volume average particle diameter thereof is from 20 μm to 200 μm.

Further, examples of the coating resin of the resin-coated carrier include: homopolymers or copolymers of two or more kinds of monomers of styrenes, such as styrene, para-chlorostyrene, and α-methyl styrene; α-methylene aliphatic monocarboxylic acids, such as methyl acrylate, ethyl acrylate, n-propyl acrylate, lauryl acrylate, 2-ethylhexyl acrylate, methyl methacrylate, n-propyl acrylate, lauryl methacrylate, and 2-ethylhexyl methacrylate; nitrogen-containing acylates, such as dimethyl amino ethyl methacrylate; vinyl nitriles, such as acrylonitrile and methacrylonitrile; vinyl pyridines, such as 2-vinyl pyridine and 4-vinyl pyridine; vinyl ethers, such as vinyl methyl ether and vinyl isobutyl ether; vinyl ketones, such as vinyl methyl ketone, vinyl ethyl ketone, and vinyl isopropenyl ketone; olefins, such as ethylene and propylene; and vinyl fluorine-containing monomers, such as vinylidene fluoride, tetrafluoroethylene, and hexafluoroethylene. Further, examples thereof include: silicone resins containing methyl silicone or methyl phenyl silicone; polyesters containing bisphenol or glycol; epoxy resins; polyurethane resins; polyamide resins; cellulose resins; polyether resins; and polycarbonate resins. These resins may be used alone or in combination of two or more kinds thereof. The coating amount of the coating resin is preferably in a range of from 0.1 parts by weight to 10 parts by weight, and more preferably in a range of from 0.5 parts by weight to 3.5 parts by weight with respect to 100 parts by weight of the core particles.

In the preparation of the carrier, a heating kneader, a heating Henschel mixer, or a UM mixer is used. Further, according to the amount of the coating resin, a heating type flow rolling bed or a heating type klin is used.

The mixing ratio of the toner and the carrier in the developer is not particularly limited, and is selected according to the purpose.

Image Forming Method

The image forming method using the electrostatic charge image developing toner according to the exemplary embodiment will be described. The electrostatic charge image developing toner according to the exemplary embodiment is used in an image forming method using known electrophotography. Specifically, this electrostatic charge image developing toner is used in an image forming method having the following processes.

That is, the preferable image forming method includes: a latent image forming process of forming an electrostatic latent image on the surface of an image holding member; a developing process of developing the electrostatic latent image formed on the surface of the image holding member with a toner to form a toner image; a transfer process of transferring the toner image to the surface of a transfer medium; and a fixing process of fixing the toner image transferred to the surface of the transfer medium. Therefore, as the toner, the electrostatic charge image developing toner according to the exemplary embodiment is used. In the transfer process, when an intermediate transfer member mediating the transfer of the toner image from the image holding member to the transfer medium is used, the effects of the invention are easily exhibited.

The image forming method according to the exemplary embodiment may further include a cleaning process of removing the toner remaining on the surface of the image holding member after the transfer process.

Each of the above processes is a general process, and, for example, is described in JP-A-56-40868 and JP-A-49-91231. In addition, the image forming method according to the exemplary embodiment may be carried out using a known image forming apparatus such as a copy machine or a facsimile machine.

The latent image forming process is a process of forming an electrostatic latent image on the surface of an image holding member (photoreceptor).

The developing process is a process of developing the electrostatic latent image with a developer layer on a developer holding member to form a toner image. The developer layer is not particularly limited as long as it contains the electrostatic charge image developing toner of the exemplary embodiment.

The transfer process is a process of transferring the toner image to the surface of a transfer medium. Further, as the transfer medium in the transfer process, a recording medium, such as an intermediate transfer member or a paper, is exemplified.

In the fixing process, for example, the toner image transferred on the transfer paper is fixed by a heating roller fixing device in which the temperature of a heating roller is set at constant temperature, to thereby form a copy image.

The cleaning process is a process of removing the electrostatic charge image developer remaining on the image holding member.

As the transfer medium, a recording medium, such as an intermediate transfer member or a paper, may be used.

As the recording medium, a paper, an OHP sheet or the like used in an electrophotographic copying machine, a printer or the like is exemplified. For example, a coat paper obtained by coating plain paper with resin or an art paper for printing may be preferably used.

The image forming method according to the exemplary embodiment may further include a recycle process. The recycle process is a process of transferring the electrostatic charge image developing toner collected in the cleaning process to the developer layer. The image forming method including this recycle process is carried out using an image forming apparatus such as a toner recycling system type copying machine or a facsimile machine. Further, in the image forming method, the cleaning process is omitted, and the recycle process may be applied to a recycling system in which the toner is collected simultaneously with developing.

Image Forming Apparatus

The image forming apparatus according to the exemplary embodiment is an image forming apparatus using the electrostatic charge image developing toner according to the exemplary embodiment. Hereinafter, the image forming apparatus according to the exemplary embodiment will be described.

The image forming apparatus according to the exemplary embodiment includes: an image holding member; a charging unit for charging the image holding member, an exposure unit for exposing the charged image holding member to light to form an electrostatic latent image on the surface of the image holding member; a developing unit for developing the electrostatic latent image with a toner to form a toner image; a transfer unit for transferring the toner image from the image holding member to the surface of a transfer medium; and a fixing unit for fixing the toner image transferred to the surface of the transfer medium. Here, it is preferable that the toner is the electrostatic charge image developing toner according to the exemplary embodiment.

In addition, the image forming apparatus according to the exemplary embodiment is not particularly limited as long as it includes at least the image holding member, the charging unit, the exposure unit, the developing unit, the transfer unit and the fixing unit, but, if necessary, may further include a cleaning unit and a discharging unit.

In the case where the image forming apparatus according to the exemplary embodiment is an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

The image holding member and each of the units may preferably use the configurations described in each process of the image forming method. As all of the units, known units in the image forming apparatus may be used. Further, the image forming apparatus according to the exemplary embodiment may include units and devices other than the above configurations. Moreover, in the image forming apparatus according to the exemplary embodiment, a plurality of units among the above units may be carried out simultaneously.

As the cleaning unit, for example, a cleaning blade or a cleaning brush is exemplified.

In the image forming apparatus according to the exemplary embodiment, for example, the portion including the developing unit may also be a cartridge structure (process cartridge) that is detachable from the image forming apparatus. As the process cartridge, the process cartridge of the exemplary embodiment, which at least has a developer holding member and accommodates the electrostatic charge image developer of the exemplary embodiment, is preferably used.

Hereinafter, an example of the image forming apparatus according to the exemplary embodiment will be described, but the invention is not limited thereto. Here, the main parts shown in the drawing are described, and others are not described.

Figure 3:
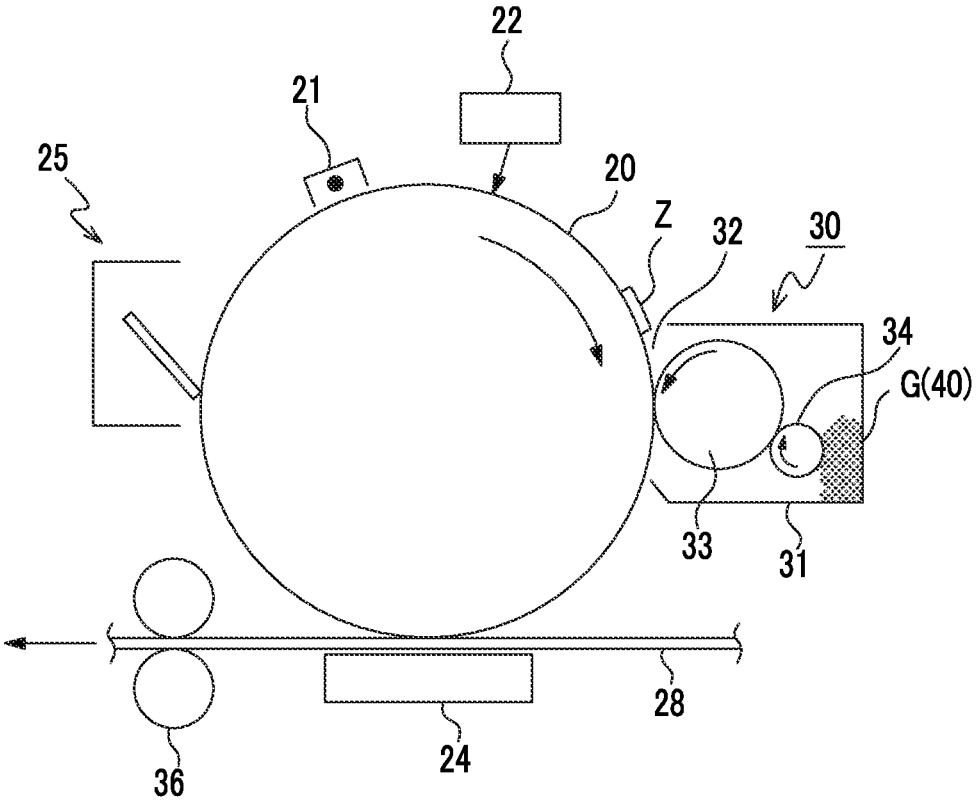
FIG. 3 is a schematic configuration view showing an example of an image forming apparatus according to the exemplary embodiment, which includes a developing device using an electrostatic charge image developer according to the exemplary embodiment.

FIG. 3 is a schematic configuration view showing an example of the image forming apparatus according to the exemplary embodiment, which include a developing device that uses the electrostatic charge image developer according to the exemplary embodiment.

As shown in FIG. 3, the image forming apparatus according to the exemplary embodiment is configured such that it has a photoreceptor 20 (an example of an image holding member) as an image holding member rotating in a predetermined direction, and the photoreceptor 20 is sequentially provided therearound with a charging device 21 (an example of a charging unit) for charging the photoreceptor 20, an exposure device 22 (an example of an exposure unit) as an electrostatic charge image forming device for forming an electrostatic charge image Z on the photoreceptor 20, a developing device 30 (an example of a developing unit) for visualizing the electrostatic charge image Z formed on the photoreceptor 20 to form a toner image, a transfer device 24 (an example of a transfer unit) for transferring the toner image visualized on the photoreceptor 20 to a recording paper 28 as a recording medium, and a cleaning device 25 (an example of a cleaning unit) for cleaning the toner remaining on the photoreceptor 20.

In the exemplary embodiment, the developing device 30, as shown in FIG. 3, has a developing container 31 accommodating a developer G containing a toner 40. This developing container 31 is provided with a developing opening 32 facing the photoreceptor 20, a developing roll (developing electrode) 33, as a toner holding member, is disposed to face the developing opening 32, and a predetermined developing bias is applied to this developing roll 33, thereby forming a developing electric field in a region (developing region) sandwiched between the photoreceptor 20 and the developing roll 33. In addition, a charge injection roll (injection electrode) 34, as a charge injection member, is provided in the developing container 31 to face the developing roll 33. Particularly, in the exemplary embodiment, the charge injection roll 34 is also used as a toner supply roll for supplying the toner 40 to the developing roll 33.

Here, although no problem in selecting the direction of rotation of the charge injection roll 34, it is preferable that considering the supply of the toner and the charge injection characteristics, the charge injection roll 34 rotates in the same direction at the portion facing the developing roll 33 to have a peripheral speed difference (for example, 1.5 times or more), the toner 40 is inserted into the region between the charge injection roll 34 and the developing roll 33, and thus charges are injected while being rubbed.

Next, the operation of the image forming apparatus according to the exemplary embodiment will be described.

When an image forming process starts, first, the surface of the photoreceptor 20 is charged by the charging device 21, the exposure device 22 writes an electrostatic charge image Z on the charged photoreceptor 20, and the developing device 30 visualizes the electrostatic charge image Z into a toner image. Thereafter, the toner image on the photoreceptor 20 is supplied to a transfer site, and the transfer device 24 electrostatically transfers the toner image on the photoreceptor 20 to the recording paper 28 as a recording medium. In addition, the toner remaining on the photoreceptor 20 is cleaned by the cleaning device 25. Then, the toner image on the recording paper 28 is fixed by the fixing device 36 (an example of a fixing unit), to thereby obtain an image.

Process Cartridge/Toner Cartridge

A process cartridge according to the exemplary embodiment will be described.

The process cartridge according to the exemplary embodiment is provided with a developing unit that contains the electrostatic charge image developer according to the exemplary embodiment and develops an electrostatic charge image formed on a surface of an image holding member with the electrostatic charge image developer to form a toner image, and is detachable from an image forming apparatus.

The process cartridge according to the exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to the exemplary embodiment will be illustrated. However, this process cartridge is not limited thereto. Major parts shown in the drawing will be described, but descriptions of other parts will be omitted.

Figure 4:
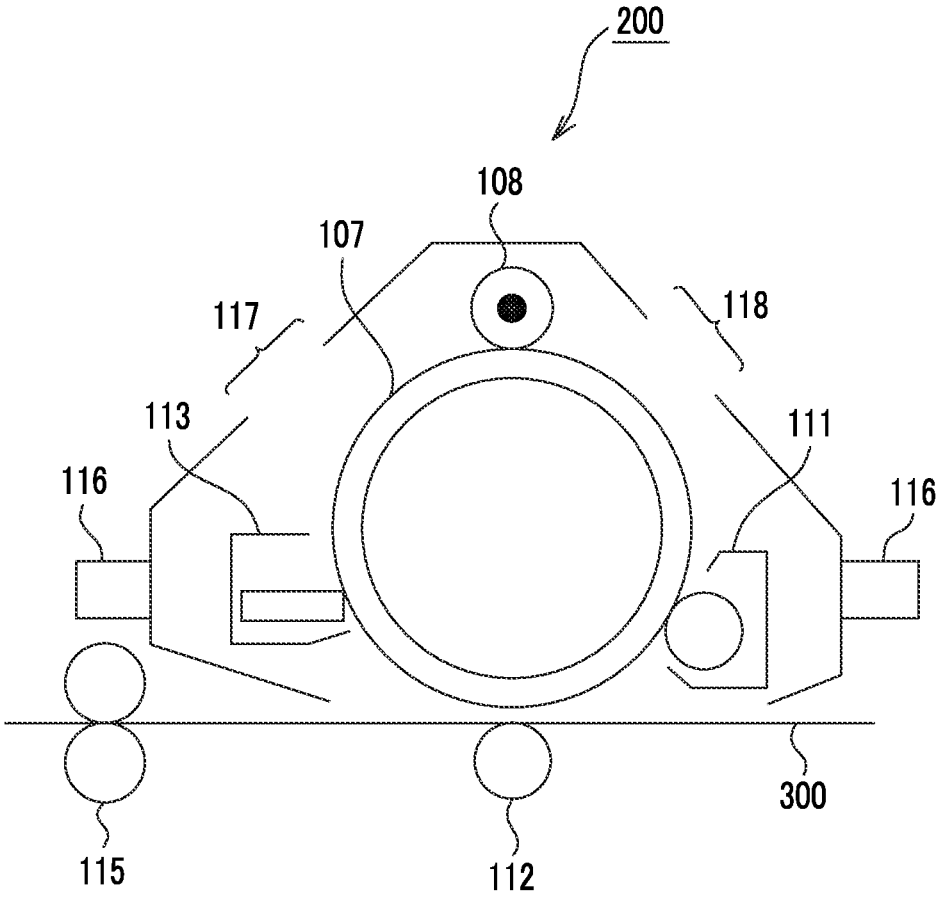
FIG. 4 is a schematic configuration view showing an example of a process cartridge which is preferably used in the exemplary embodiment.

FIG. 4 is a schematic configuration view showing an example of the process cartridge according to the exemplary embodiment.

As shown in FIG. 4, the process cartridge 200 is configured such that a photoreceptor 107 (an example of an image holding member), a charging roll 108 (an example of a charging unit) provided around the photoreceptor 107, a developing device ill (an example of a developing unit) and a photoreceptor cleaning device 113 (an example of a cleaning unit) are integrally combined and kept by a housing provided with a mounting roll 116 and openings 117 and 118 for exposure.

In FIG. 4, the reference numeral 109 expresses an exposure device (an example of an exposure unit), 112 expresses a transfer device (an example of a transfer unit), 115 expresses a fixing device (an example of a fixing unit), and 300 expresses a recording paper (an example of a recording medium).

The image forming apparatus shown in FIG. 3 is an image forming apparatus having a freely-detachable toner cartridge (not shown), and the developing device 30 is connected with the toner cartridge through a toner supply tube (not shown). In addition, when the amount of the toner accommodated in the toner cartridge is small, this toner cartridge may be replaced. The toner cartridge which is detachable from an image forming apparatus may include a container which accommodates the toner.

EXAMPLES

Hereinafter, the exemplary embodiment will be described in more detail with reference to Examples and Comparative Examples below, but is not limited thereto.

In the following Examples, "parts" means "parts by weight", and "%" means "% by weight", unless specified otherwise.

Measuring Method

In the case of observing the ratio (C/D), volume average particle diameter, the number of the metallic pigments which satisfy a condition that, in the case of observing a cross-section of the toner particle in a thickness direction thereof, the angle between the long axis direction in the cross-section of the toner particle and the long axis direction of the metallic pigment is in a range of from −30° to +30° (the number of flake shape pigments), and the particle size distribution of an external additive are measured by the above-described methods, respectively.

Preparation of External Additive 1: Preparation of Zinc Stearate Particles 1,422 parts of steric acid is added to 10,000 parts of ethanol and mixed at 68° C., 507 parts of zinc hydroxide is slowly added little by little, and after the addition, mixing is performed for 4 hours. After the mixing, the obtained product is cooled to 20° C., and filtrated to remove ethanol and reaction residues, to thereby obtain a solid product, and this solid product is dried by a heating type vacuum dryer at 150° C. for 3 hours. After taking out from the dryer, cooling is performed to obtain a solid product of zinc stearate. The obtained solid product is pulverized by a jet mill, and then classified by an Elbow Jet classifier (manufactured by MATSUBO Corporation), to thereby obtain zinc stearate particles (external additive 1). The particle size distribution of the external additive 1 (ratio of particles of 25 μm or more) is shown in Table 1 below. The classification cut point in classification by Elbow Jet classifier is set to 30 μm.

Preparation of External Additive 2: Preparation of Magnesium Stearate Particles 1,422 parts of steric acid is added to 10,000 parts of ethanol and mixed at 68° C., 298 parts of magnesium hydroxide is slowly added little by little, and after the addition, mixing is performed for 4 hours. Then, the obtained product is cooled to 20° C., and filtrated to remove ethanol and reaction residues, to thereby obtain a solid product, and this solid product is dried by a heating type vacuum dryer at 150° C. for 3 hours. After cooling and extraction from the dryer, a solid product of magnesium stearate is obtained. The obtained solid product is pulverized and classified in the same manner as in the preparation of the external additive 1, to thereby obtain magnesium stearate particles (external additive 2). The particle size distribution of the external additive 2 (ratio of particles of 25 μm or more) is shown in Table 1 below.

Preparation of External Additive 3: Preparation of Zinc Laurate Particles 1,001 parts of lauric acid is added to 10,000 parts of ethanol and mixed at 68° C., 507 parts of zinc hydroxide is slowly added little by little, and mixing is performed for 4 hours after the introduction. After the mixing, the obtained product is cooled to 20° C., and filtrated to remove ethanol and reaction residues, to thereby obtain a solid product, and this solid product is dried by a heating type vacuum dryer at 150° C. for 3 hours. After taking out from the dryer, cooling is performed to obtain a solid product of zinc laurate. The obtained solid product is pulverized and classified in the same manner as in the preparation of the external additive 1, to thereby obtain zinc laurate particles (external additive 3). The particle size distribution of the external additive 3 (ratio of particles of 25 μm or more) is shown in Table 1 below.

Preparation of External Additives 4, 5 and 6: Preparation of Zinc Stearate Particles External additives 4, 5 and 6 are prepared in the same manner as in the preparation of the external additive 1, except that the temperatures at the time of mixing ethanol and stearic acid are set to 70° C., 74° C., and 65° C., respectively, and the classification cut points at the time of being classified by Elbow Jet classifier are set to 35 μm, 25 μm, and 40 μm.

The particle size distributions of the external additives 3 and 4 (ratio of particles having a diameter of 25 μm or more) are shown in Table 1 below.

Preparation of Titanium Compound Particles

Titanium compound particles are prepared as follows.

Specifically, ilmenite, as ore, is dissolved in sulfuric acid to separate iron, to thereby obtain $TiOSO_4$, and this $TiOSO_4$ is hydrolyzed, and washed with water until the pH of a filtrate is constant. After 3 N hydrochloric acid is added to adjust the pH to 6.5 to 7, concentrated sulfuric acid is added to adjust the concentration of hydrochloric acid to 110 g/L and adjust the $TiO_2$ concentration to 50 g/L, and the resultant is stirred at 30° C. for 2 hours and then kept, to thereby prepare a $TiO(OH)_2$ slurry. 100 parts by weight (reduced by $TiO(OH)_2$) of the obtained $TiO(OH)_2$ slurry is mixed with 38 parts by weight of tertiary butyl trimethoxysilane, and stirred at 80° C. for 30 minutes. Then, a 7 N sodium hydroxide aqueous solution is added to neutralize this slurry to a pH of 6.8, and this neutralized slurry is filtrated by suction funnel and washed with water. Thereafter, after drying at 120° C. for 10 hours, soft aggregation is released by a pin mill, to thereby prepare titan compound particles 1.

The volume average particle diameter of the obtained titan compound particles 1 is 30 nm.

Preparation of the Toner Particles (1)

Synthesis of Binder Resin

Bisphenol A ethylene oxide (2 mol) adduct: 216 parts

Ethylene glycol: 38 parts

Terephthalic acid: 200 parts

Tetrabutoxytitanate (catalyst): 0.037 parts

The above components are put into a two-neck flask dried by heating, nitrogen gas is introduced into the flask to keep an inert atmosphere, heating is performed while performing stirring. Then, a copolycondensation reaction is performed at 160° C. for 7 hours, and then the reaction product is heated to 220° C. while slowly reducing pressure to 10 torr, and is kept for 8 hours. After releasing to normal pressure, 9 parts of trimellitic anhydride is added thereto, and the obtained reaction product is kept at 220° C. for 2 hours while slowly reducing pressure to 10 torr again, to thereby synthesize a binder resin.

Preparation of Resin Particle Dispersion

Binder resin: 160 parts

Ethyl acetate: 233 parts

Sodium hydroxide aqueous solution (0.3 N): 0.1 part

The above components are put in a separable flask, followed by heating at 70° C., and the resultant is stirred with a Three-One motor (manufactured by Shinto Scientific Co., Ltd.), thereby preparing a resin mixture solution. While this resin mixture solution is further stirred, 373 parts of ion exchange water is slowly added thereto to cause phase inversion emulsification, and the solvent is removed, thereby obtaining a resin particle dispersion (solid content concentration: 30%).

Preparation of Release Agent Dispersion

Carnauba wax (manufactured by TOA KASEI CO., LTD., RC-160): 50 parts

Anionic surfactant (manufactured by DAI-ICHI KOGYO SEIYAKU CO., LTD., NEOGEN RK): 1.0 part Ion exchange water: 200 parts The above components are mixed and heated to 95° C., and dispersed using a homogenizer (manufactured by IKA, Ultra Turrax T50). Thereafter, the resultant is dispersed for 360 minutes by using a Manton-Gaulin high pressure homogenizer (manufactured by Gaulin Corporation), thereby preparing a release agent dispersion (solid content concentration: 20%) in which release agent particles having a volume average particle diameter of 0.23 μm are dispersed.

Preparation of Metallic Pigment Particle Dispersion

Preparation of Metallic Pigment 1

Formation of First Coating Layer 154 parts (100 parts based on aluminum) of metallic pigment (aluminum pigment, item number: 2173, solid content: 65%, manufactured by Showa Aluminum Corporation) is added to 500 parts of methanol, followed by stirring at 60° C. for 1.5 hours, to thereby obtain a slurry. Then, ammonia is added to the obtained slurry to adjust the pH of the slurry to 8.0. Then, 15 parts of tetraethoxysilane is added to this pH-adjusted slurry, and stirred at 60° C. for 5 hours. Subsequently, this obtained slurry is filtrated, and the filtrated slurry containing a coated metallic pigment is dried at 110° C. for 3 hours to thereby obtain silica-coated pigment particle 1.

Formation of Second Coating Layer 500 parts of mineral spirit is added to silica-coated metallic pigment particle 1, and heated to 80° C. while blowing nitrogen gas. Then, 0.5 parts of acrylic acid, 9.8 parts of epoxidized polybutadiene, 12.2 parts of trimethylol propane triacrylate, 4.4 parts of divinyl benzene, and 1.8 parts of azobisisobutyronitrile are added thereto, and the resultant is polymerized at 80° C. for 5 hours, to thereby obtain a slurry. Thereafter, the obtained slurry is filtrated, and the filtrated slurry containing a coated metallic pigment is dried at 150° C. for 3 hours. In this way, a metallic pigment 1 having the first coating layer and the second coating layer is obtained.

Preparation of Metallic Pigment Dispersion 1

Metallic pigment 1: 100 parts

Anionic surfactant (manufactured by DAI-ICHI KOGYO SEIYAKU CO., LTD., NEOGEN R): 1.5 parts Ion exchange water: 400 parts The above components are mixed, dispersed using an emulsification dispersing machine CAVITRON (CR1010, manufactured by Pacific Machinery & Engineering Co., Ltd.) for 1 hour, and kept for about 2 hours, and then a supernatent solution is removed. In addition, similarly, 400 parts of ion exchange water is added, dispersed using the emulsification dispersing machine CAVITRON for 1 hour, and kept for about 2 hours, and then a supernatent solution is removed. Again, 400 parts of ion exchange water is added, and dispersed for 1 hour, to thereby prepare metallic pigment dispersion 1 (solid concentration: 10%).

Preparation of the Toner Particles (1)

Resin particle dispersion: 450 parts

Release agent dispersion: 50 parts

Metallic pigment dispersion: 21.74 parts

Nonionic surfactant (IGEPAL CA897, manufactured by Rhodia Co., Ltd.): 1.40 parts The above components are put into a cylindrical stainless steel container, followed by dispersion and mixing for 10 minutes with a homogenizer (manufactured by IKA, ULTRA-TURRAX T50) while applying a shearing force at 4,000 rpm. Next, 1.75 parts of a 10% nitric acid aqueous solution of polyaluminum chloride as a coagulant is slowly added dropwise, followed by dispersion and mixing with the homogenizer at 5,000 rpm for 15 minutes. As a result, a raw material dispersion is obtained.

Thereafter, the raw material dispersion is put into a polymerization kettle which includes a stirring device using a two-paddle stirring blade for generating a laminar flow and a thermometer, followed by heating with a mantle heater under stirring at 810 rpm to promote the growth of aggregated particles at 54° C. At this time, the pH value of the raw material dispersion is adjusted to a range of 2.2 to 3.5 using 0.3 N nitric acid and a 1 N sodium hydroxide aqueous solution. The resultant is held in the above-described pH value range for about 2 hours and aggregated particles are formed. At this time, the volume average particle diameter of the aggregated particles which is measured using a MULTISIZER II (aperture diameter: 50 μm, manufactured by Beckman Coulter, Inc.) is 10.4 μm.

Next, 100 parts of the resin particle dispersion is further added thereto so that the resin particles of the binder resin are allowed to adhere to the surfaces of the aggregated particles. The temperature is further raised to 56° C., and the aggregated particles are adjusted while observing the size and the forms of the particles with an optical microscope and a MULTISIZER II. Subsequently, in order to cause the aggregated particles to coalesce, the pH value is increased to 8.0 and then the temperature is raised to 67.5° C. After the coalescence of the aggregated particles is confirmed with the optical microscope, the pH value is decreased to 6.0 while maintaining the temperature of 67.5° C. After 1 hour, heating is stopped and cooling is performed at a temperature decreasing rate of 1.0° C./min. The particles are then sieved through a 20 μm mesh, repeatedly washed with water, and then dried in a vacuum dryer. As a result, the toner particles (1) are obtained.

Preparation of the Toner Particles (2)

the toner particles (2) are prepared in the same manner as in the preparation of the toner particles (1), except that the stirring rotation speed in the process of promoting the growth of aggregated particles is changed from 810 rpm to 600 rpm, and the temperature in the process of coalescing aggregated particles is changed from 67.5° C. to 74° C.

Preparation of the Toner Particles (3)

the toner particles (3) are prepared in the same manner as in the preparation of the toner particles (1), except that the stirring rotation speed in the process of promoting the growth of aggregated particles is changed from 810 rpm to 520 rpm, and the temperature in the process of coalescing aggregated particles is changed from 67.5° C. to 80° C.

Preparation of Toner

The amount of the aliphatic acid metal salt particles described in Table 1 and 0.5 parts of titanium compound particles are added to 100 parts of the toner particles described in Table 1, and mixed at a peripheral speed of 22 m/s for 3 minutes using a Henschel mixer. Thereafter, the resultant is sieved with a vibration sieve having an aperture of 45 μm, to thereby prepare each toner used in Examples and Comparative Examples.

Preparation of Carrier

Ferrite particles (volume average particle diameter: 35 μm): 100 parts

Toluene: 14 parts

Polymethyl methacrylate (weight average molecular weight: 75,000): 1.6 parts

The above materials are put into a vacuum degassing kneader, and stirred at 60° C. for 30 minutes, and then toluene is removed under reduced pressure to form a resin-coated layer, thereby obtaining a carrier.

Preparation of Developer 32 parts of the toner and 418 parts of the carrier are put into a V-blender, stirred for 20 minutes, and then sieved to 212 μm, thereby preparing a developer.

Evaluation Test

Brilliance Evaluation

A solid image is formed by the following method.

A developer, as a sample, is put into a developing device (DocuCentre-III C7600, manufactured by Fuji Xerox Co., Ltd.), and seasoned overnight under an environment of high temperature and high humidity (35° C., 80RH %). Then, 50,500 sheets of solid image (3 cm×4 cm) having a toner amount of 4.0 g/cm$^2$ are continuously formed on a recording paper (OK topcoat paper, manufactured by Oji Paper Co., Ltd.) at a fixing temperature of 180° C. and a fixing pressure 4.0 kg/cm$^2$.

With respect to these second and 50,500$^{th}$ solid images, the value of brilliance (ratio A/B) is measured by the above-described method.

Here, in the evaluation of brilliance, measurement is carried out at three points of the solid image, and the average value thereof is set to the value of brilliance.

Evaluation of Uniformity of Brilliance

The uniformity of brilliance is determined by evaluating the variation (((averaged value−measured value being most far from averaged value)/averaged value)×100) based on the values measured at the above three points of the solid image.

A: variation is 50 or less

B: variation is more than 5% and 10% or less

C: variation is more than 10% and 15% or less

D: variation is more than 15%

Here, allowable evaluation results are A, B, and C.

TABLE 1

| | | Toner | | | | Aliphatic acid metal salt particle | | | | brilliance | | Uniformity of |
|---|---|---|---|---|---|---|---|---|---|---|---|---|
| | | No. | Volume average particle diameter (μm) | Flake shape pigment (% by number) | C/D | No. | Kind | External additive amount (part by weight) | Particle size distribution | initial | After applying stress | brilliance After applying stress |
| Example | 1 | 1 | 12.5 | 85 | 0.075 | 1 | Zinc stearate | 1.00 | 0.3 | 64 | 63 | A |
| | 2 | 2 | 13.0 | 70 | 0.208 | 1 | Zinc stearate | 1.00 | 0.3 | 24 | 24 | A |
| | 3 | 3 | 12.2 | 62 | 0.45 | 1 | Zinc stearate | 1.00 | 0.3 | 6 | 6 | B |
| | 4 | 1 | 12.5 | 85 | 0.075 | 2 | Magnesium stearate | 1.00 | 0.3 | 63 | 62 | B |
| | 5 | 1 | 12.5 | 85 | 0.075 | 3 | Zinc laurate | 1.00 | 0.3 | 62 | 60 | C |
| | 6 | 1 | 12.5 | 85 | 0.075 | 1 | Zinc stearate | 2.00 | 0.3 | 65 | 63 | B |
| | 7 | 1 | 12.5 | 85 | 0.075 | 4 | Zinc stearate | 1.00 | 0.5 | 66 | 64 | B |
| | 8 | 1 | 12.5 | 85 | 0.075 | 4 | Zinc stearate | 2.00 | 0.5 | 64 | 63 | B |
| | 9 | 1 | 12.5 | 85 | 0.075 | 5 | Zinc stearate | 1.00 | 0.1 | 63 | 63 | B |
| | 10 | 1 | 12.5 | 85 | 0.075 | 6 | Zinc stearate | 2.00 | 0.6 | 63 | 62 | C |
| | 11 | 1 | 12.5 | 85 | 0.075 | 1 | Zinc stearate | 0.15 | 0.05 | 63 | 61 | C |

TABLE 1-continued

| | | Toner | | | | Aliphatic acid metal salt particle | | | | | | |
|---|---|---|---|---|---|---|---|---|---|---|---|---|
| | | No. | Volume average particle diameter (μm) | Flake shape pigment (% by number) | C/D | No. | Kind | External additive amount (part by weight) | Particle size distribution | brilliance initial | brilliance After applying stress | Uniformity of brilliance After applying stress |
| Comparative example | 1 | 1 | 12.5 | 85 | 0.075 | — | — | — | — | 62 | 60 | D |
| | 2 | 1 | 12.5 | 85 | 0.075 | 1 | Zinc stearate | 3.40 | 1 | 65 | 63 | D |
| | 3 | 1 | 12.5 | 85 | 0.075 | 1 | Zinc stearate | 0.05 | 0.02 | 64 | 61 | D |

Examples 1 to 11, in which an aliphatic acid metal salt is used as an external additive for the purpose of stability of brilliance, are excellent in effects, compared to Comparative Example 1 in which the aliphatic acid metal salt particles are not used as an external additive.

Examples 1 to 11, in which an aliphatic acid metal salt is used in an amount of from 0.1 parts by weight to 2.0 parts by weight with respect to 100 parts by weight of a toner, are excellent in effects, compared to Comparative Examples 2 and 3.

Examples 7 and 8, in which the content of particles having a particle diameter of 25 μm or more in the aliphatic acid metal salt particles is 0.5 parts by weight or less with respect to 100 parts by weight of a toner, are excellent in effects, compared to Example 10.

Examples 1 and 2, in which the number percentage of flake shape pigments is 70% by number or more, are excellent in effects, compared to Example 3.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

a toner particle containing a binder resin and a metallic pigment; and aliphatic acid metal salt particles as an external additive in an amount of from 0.1 parts by weight to 2.0 parts by weight with respect to 100 parts by weight of the toner particles, a volume average particle diameter of the aliphatic metal salt particles is in the range of from 2 μm to 20 μm, a content of the aliphatic acid metal salt particles having a particle diameter of 25 μm or more is in the range of 0.1 to 0.5 parts by weight with respect to 100 parts by weight of the toner, and the aliphatic acid metal salt particles are particles of an aliphatic acid metal salt composed of at least one aliphatic acid selected from the group consisting of stearic acid and lauric acid and at least one metal selected from the group consisting of magnesium, calcium and zinc, wherein the toner particles have an average circle equivalent diameter D longer than an average C of a maximum thickness of the toner particles.

2. The electrostatic charge image developing toner according to claim 1, wherein a number of particles of the metallic pigment arranged so that an angle between a long axis direction in the cross section of the toner particle and a long axis direction of a particle of the metallic pigment is in a range of −30° to +30° is equal to or greater than 70% of the total number of particles of the metallic pigment.

3. The electrostatic charge image developing toner according to claim 1, wherein a ratio C/D of an average C of a maximum thickness of the toner particles to an average circle equivalent diameter D is from 0.001 to 0.500.

4. The electrostatic charge image developing toner according to claim 1, wherein the metallic pigment is powder of at least one metal selected from the group consisting of aluminum, brass, bronze, nickel, stainless steel, zinc, copper, silver, gold, and platinum, or is metal powder on which the metal is deposited.

5. The electrostatic charge image developing toner according to claim 1, wherein the metallic pigment has a first coating layer containing at least one metal oxide selected from silica, alumina, and titania and a second coating layer containing a second binder resin and covering the surface of the first coating layer.

6. The electrostatic charge image developing toner according to claim 5, wherein a coated amount of the first coating layer is from 10% by weight to 40% by weight with respect to the weight of the metallic pigment.

7. The electrostatic charge image developing toner according to claim 5, wherein a coated amount of the second coating layer is from 5% by weight to 30% by weight with respect to the weight of the metallic pigment.

8. The electrostatic charge image developing toner according to claim 5, wherein the second coating layer contains an acrylic resin.

9. An electrostatic charge image developer comprising the electrostatic charge image developing toner according to claim 1 and a carrier.

10. A toner cartridge which is detachable from an image forming apparatus, comprising a container which accommodates the electrostatic charge image developing toner according to claim 1.

11. The electrostatic charge image developing toner according to claim 1, wherein the content of the aliphatic acid metal salt particles having a particle diameter of 25 μm or more is in the range of 0.2 to 0.4 parts by weight with respect to 100 parts by weight of the toner.

12. The electrostatic charge image developing toner according to claim 1, wherein the volume average particle diameter of the aliphatic metal salt particles is in the range of from 5 μm to 15 μm.

* * * * *